US008278829B1

(12) United States Patent
Rogers

(10) Patent No.: US 8,278,829 B1
(45) Date of Patent: Oct. 2, 2012

(54) METHOD AND APPARATUS FOR REDUCING RADIATION FROM A LIGHT FIXTURE

(75) Inventor: Norman L. Rogers, Miami, FL (US)

(73) Assignee: Miami Green Licensing, LLC, Miami, FL (US)

( * ) Notice: Subject to any disclaimer, the term of this patent is extended or adjusted under 35 U.S.C. 154(b) by 330 days.

(21) Appl. No.: 12/704,498

(22) Filed: Feb. 11, 2010

(51) Int. Cl.
*H05B 39/00* (2006.01)
*H05B 37/02* (2006.01)

(52) U.S. Cl. ..... 315/185 R; 315/98; 315/100; 315/276; 315/DIG. 5

(58) Field of Classification Search ..... 315/98, 315/100, 185 R, 276, DIG. 5
See application file for complete search history.

(56) References Cited

U.S. PATENT DOCUMENTS

| | | | | | |
|---|---|---|---|---|---|
| 2,386,914 | A * | 10/1945 | Slepian | 315/100 |
| 4,277,726 | A * | 7/1981 | Burke | 315/98 |
| 4,734,650 | A * | 3/1988 | Alley et al. | 324/414 |
| 4,766,353 | A * | 8/1988 | Burgess | 315/324 |
| 4,906,899 | A * | 3/1990 | Hope et al. | 315/96 |
| 5,568,018 | A * | 10/1996 | Muzic | 315/276 |
| 6,118,227 | A * | 9/2000 | Beland | 315/276 |
| 2009/0195174 | A1* | 8/2009 | Jin | 315/277 |
| 2011/0133656 | A1* | 6/2011 | Balasubramanian | 315/185 R |

* cited by examiner

*Primary Examiner* — Douglas W Owens
*Assistant Examiner* — Thai Pham
(74) *Attorney, Agent, or Firm* — Heimlich Law, PC; Alan Heimlich, Esq.

(57) ABSTRACT

A method and apparatus for reducing unwanted radiation from a light fixture have been disclosed.

17 Claims, 11 Drawing Sheets

METHOD AND APPARATUS FOR REDUCING RADIATION FROM A LIGHT FIXTURE

FIELD OF THE INVENTION

The present invention pertains to lighting. More particularly, the present invention relates to a method and apparatus for reducing radiation from a light fixture.

BACKGROUND OF THE INVENTION

Lighting is useful to illuminate areas and objects.

Many houses, businesses, rooms in houses, etc. use lighting fixtures. Often these lighting fixtures are in proximity to people and/or sensitive equipment. Often these lighting fixtures can radiate more than visible radiation. This radiation may present a problem.

For example, fluorescent lights driven by electronic ballasts emit incidental radio frequency radiation that must be limited according to regulations promulgated by various governments. If a fluorescent tube or the connecting wires conduct an oscillating current they will in general act as an antenna.

FIG. 1, generally at 100, shows how dual fluorescent tubes are typically connected to a ballast. At 102 is a power source (e.g. an alternating current (AC)) connected to a ballast 104 having common outputs 106 (denoted Y and Y) connected to fluorescent tubes 120 and 122 at one end, and the fluorescent tube 120 other end connected to ballast 104 outputs 110 (denoted B and B), and the fluorescent tube 122 other end connected to ballast 104 outputs 108 (denoted R and R). At 121 and 123 are representative current flows in fluorescent tubes 120 and 122 indicating they are in the same direction. This reinforces radiation emanating from fluorescent tubes 120 and 122.

FIG. 2, generally at 200, shows how dual fluorescent tubes are connected to a ballast with filaments in series. At 202 is a power source (e.g. an alternating current (AC)) connected to a ballast 204 having common outputs 206 (denoted O and O) connected to fluorescent tubes 220 and 222 with the respective filaments in series, and the fluorescent tube 220 other end connected to ballast 204 outputs 110 (denoted B and B), and the fluorescent tube 222 other end connected to ballast 204 outputs 208 (denoted R and R). At 221 and 223 are representative current flows in fluorescent tubes 220 and 222 indicating they are in the same direction. This reinforces radiation emanating from fluorescent tubes 220 and 222.

BRIEF DESCRIPTION OF THE DRAWINGS

The invention is illustrated by way of example and not limitation in the figures of the accompanying drawings in which.

SUMMARY OF THE INVENTION

Figure 1:
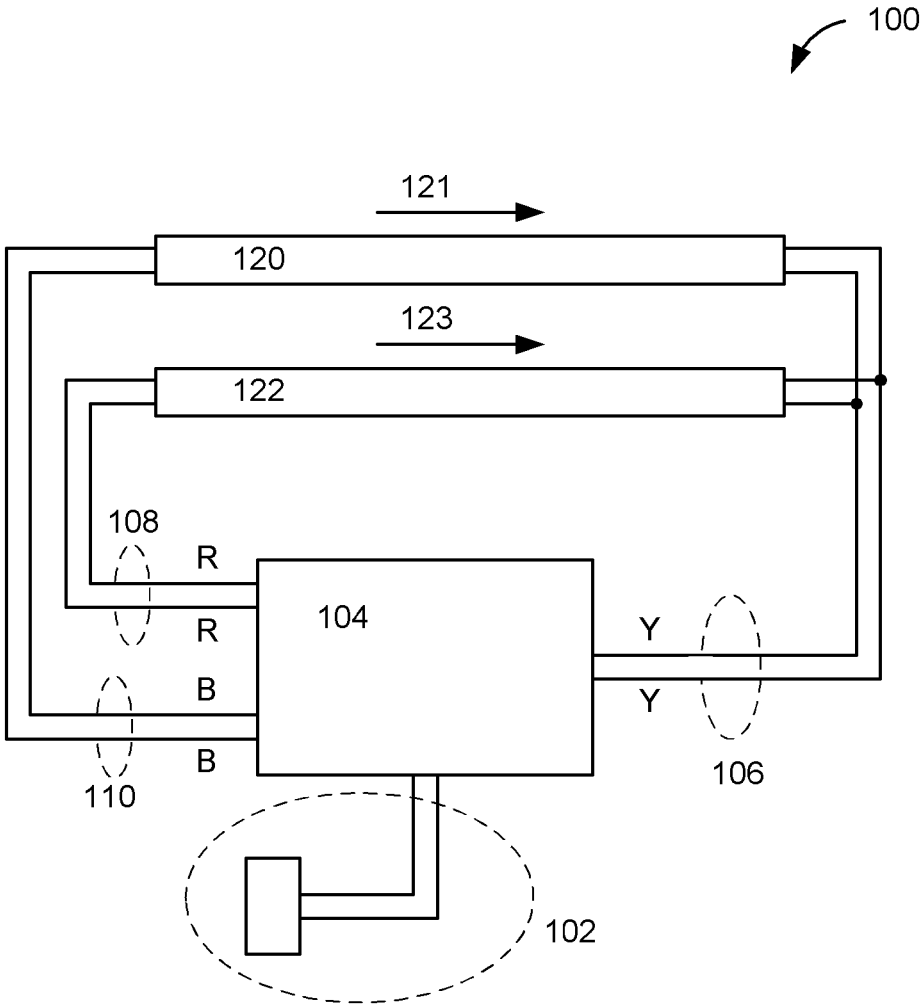
FIG. 1 (Prior Art)
FIG. 1 illustrates a prior known approach to wiring for fluorescent tubes in a lighting fixture.
Figure 2:
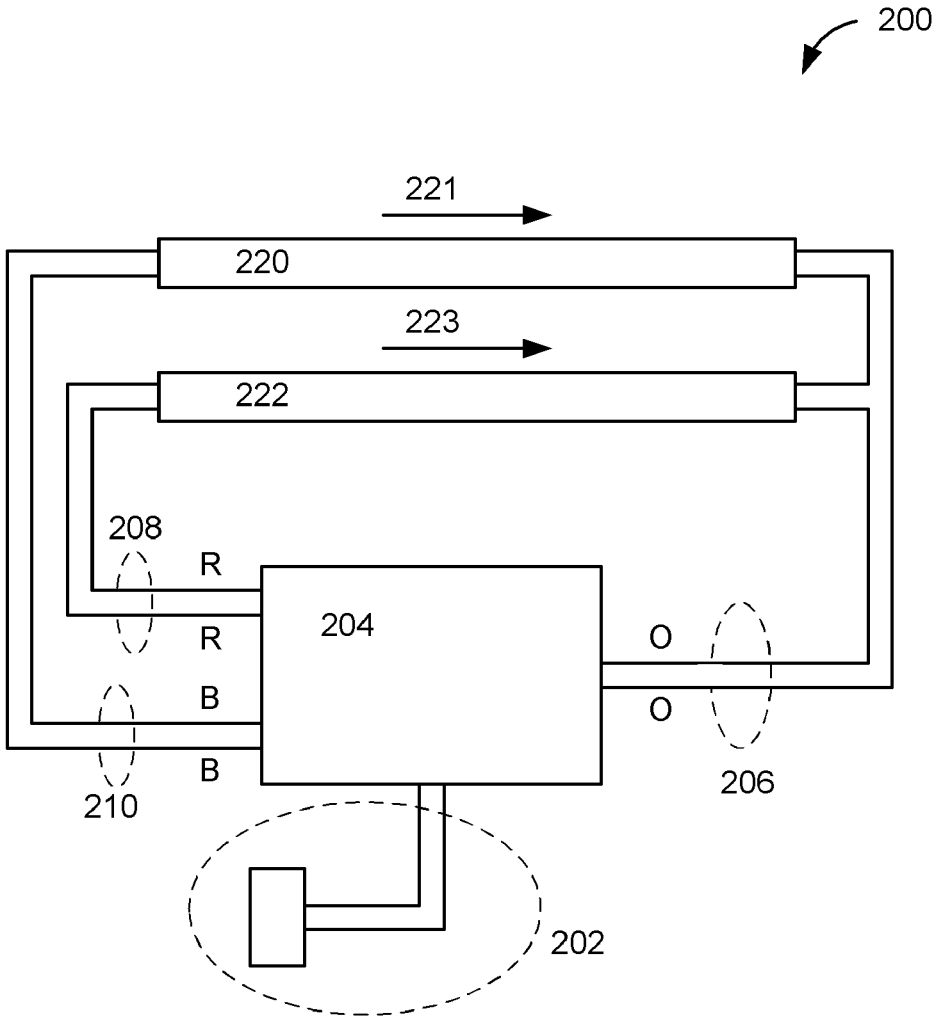
FIG. 2 (Prior Art)
FIG. 2 illustrates a prior known approach to wiring for fluorescent tubes in a lighting fixture where filaments are in series.

Applicant hereby submits that this Summary of the Invention complies with applicable CN (China i.e. SIPO) standards. All claims are literally copied here.

1. An apparatus comprising an electrically powered lighting fixture, said electrically powered lighting fixture having an even number of lighting elements wherein one-half of said even number of lighting elements have a current flowing in a first direction and wherein a remaining one-half of said even number of lighting elements have a current flowing in a second direction.

2. The apparatus of claim 1 wherein said first direction and said second direction are substantially opposite directions.

3. The apparatus of claim 2 wherein said electrically powered lighting fixture is an alternating current electrically powered lighting fixture.

4. The apparatus of claim 3 wherein said alternating current electrically powered lighting fixture is an alternating current electrically powered fluorescent lighting fixture.

5. The apparatus of claim 4 further comprising a ballast, said ballast in operative communication with said even number of lighting elements.

6. The apparatus of claim 5 wherein said even number of lighting elements are physically proximate to each other.

7. The apparatus of claim 2 further comprising an additional lighting element wherein said additional lighting element has a current flowing in a direction selected from the group consisting of said first direction and said second direction.

8. A method comprising:

arranging a first fluorescent tube in a first direction;

arranging a second fluorescent tube in a second direction, said second direction parallel to said first direction;

wiring said first fluorescent tube to a first electrical source such that at a time T a current in said first fluorescent tube is flowing in a first current direction; and wiring said second fluorescent tube to a second electrical source such that at said time T a current in said second fluorescent tube is flowing in a second current direction; and wherein said first current direction and said second current direction are not in a same direction.

9. The method of claim 8 wherein said first fluorescent tube is proximate to said second fluorescent tube.

10. The method of claim 8 further comprising wiring said first fluorescent tube and said second fluorescent tube in series.

11. The method of claim 9 wherein said first electrical source and said second electrical source are supplied from a ballast.

12. An apparatus comprising:

a first fluorescent lamp, said first fluorescent lamp having a first end and a second end, said first end having one or more electrical contacts, said second end having one or more electrical contacts;

a second fluorescent lamp, said second fluorescent lamp having a first end and a second end, said first end having one or more electrical contacts, said second end having one or more electrical contacts, wherein said second fluorescent lamp said first end is proximate to said first fluorescent lamp said second end, and wherein said second fluorescent lamp said second end is proximate to said first fluorescent lamp said first end;

a ballast, said ballast having a common output denoted Y, said ballast having a first output denoted R, said ballast having a second output denoted B, wherein said ballast said common output denoted Y is in operative communication with said first fluorescent lamp said second end said one or more electrical contacts, wherein said ballast said common output denoted Y is in operative communication with said second fluorescent lamp said second end said one or more electrical contacts, wherein said ballast said first output denoted R is in operative communication with said second fluorescent lamp said first end said one or more electrical contacts, and wherein said ballast said second output denoted B is in operative communication with said first fluorescent lamp said first end said one or more electrical contacts.

13 The apparatus of claim 12 wherein said ballast is a rapid start ballast.

14. The apparatus of claim 12 wherein said ballast is an electronic ballast.

15. A method comprising arranging an even number of lighting elements proximate to one another so that current in adjacent said lighting elements is flowing in opposite directions.

16. The method of claim 15 wherein said lighting elements are fluorescent tubes.

17. The method of claim 16 wherein said fluorescent tubes are arranged proximate to a common plane.

DETAILED DESCRIPTION

Radiation other than visible light can be emitted by lamps, bulbs, tubes, etc. used for providing visible light, UV light, or Infrared light, for example, fluorescent lights driven by electronic ballasts emit incidental radio frequency radiation. It is this unwanted radiation (radiation) that the present invention addresses.

In one embodiment of the invention fluorescent tubes (tubes) can be connected in such a manner to make the current in the tubes be out of phase, thus reducing radiation. Such a connection scheme can be extended to any even number of tubes where it is possible to make connections such that the currents in pairs of tubes are out of phase.

In one embodiment of the invention for best results the wires carrying opposite currents should be bundled close together and be of the same length. It is also desirable that the tubes be as close together as optical considerations allow.

If a fluorescent tube and/or the connecting wires conduct an alternating current they will in general act as an antenna, so if a second tube and connecting wiring conducts an approximately equal and opposite alternating current it will emit radiation 180 degrees out of phase with the first tube. The two tubes will then approximately cancel each other out, especially in the far field.

Figure 3:
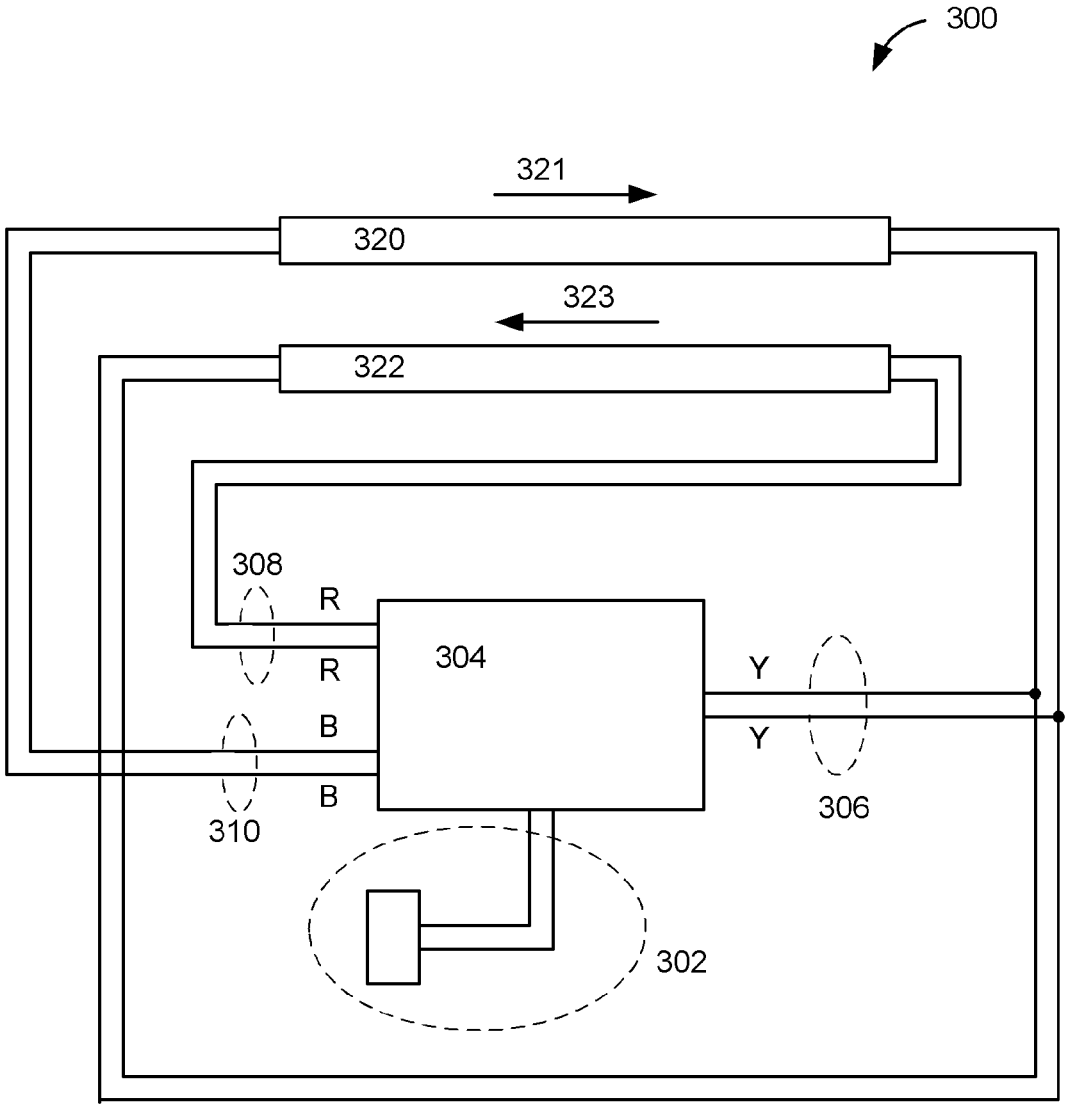
FIG. 3 illustrates one embodiment of the invention showing an approach to minimize radiation.

FIG. 3, generally at 300, shows one embodiment of the invention showing how dual fluorescent tubes are connected to a ballast to have opposing current flows in the tubes to help cancel radiation. At 302 is a power source (e.g. an alternating current (AC)) connected to a ballast 304 having common outputs 306 (denoted Y and Y) connected to fluorescent tube 320 at one end and to tube 322 at one end which is physically proximate to tube 320's other end (in FIG. 3 on the left), and the fluorescent tube 320 other end connected to ballast 304 outputs 310 (denoted B and B), and the fluorescent tube 322 other end connected to ballast 304 outputs 308 (denoted R and R). At 321 and 323 are representative current flows in fluorescent tubes 320 and 322 indicating they are in opposite directions. This opposite direction helps cancel radiation emanating from fluorescent tubes 320 and 322.

One of skill in the art will appreciate that the connection scheme, such as disclosed above and illustrated in FIG. 3, can be extended to any even number of tubes where it is possible to make connections such that the currents in pairs of tubes are out of phase.

Figure 4:
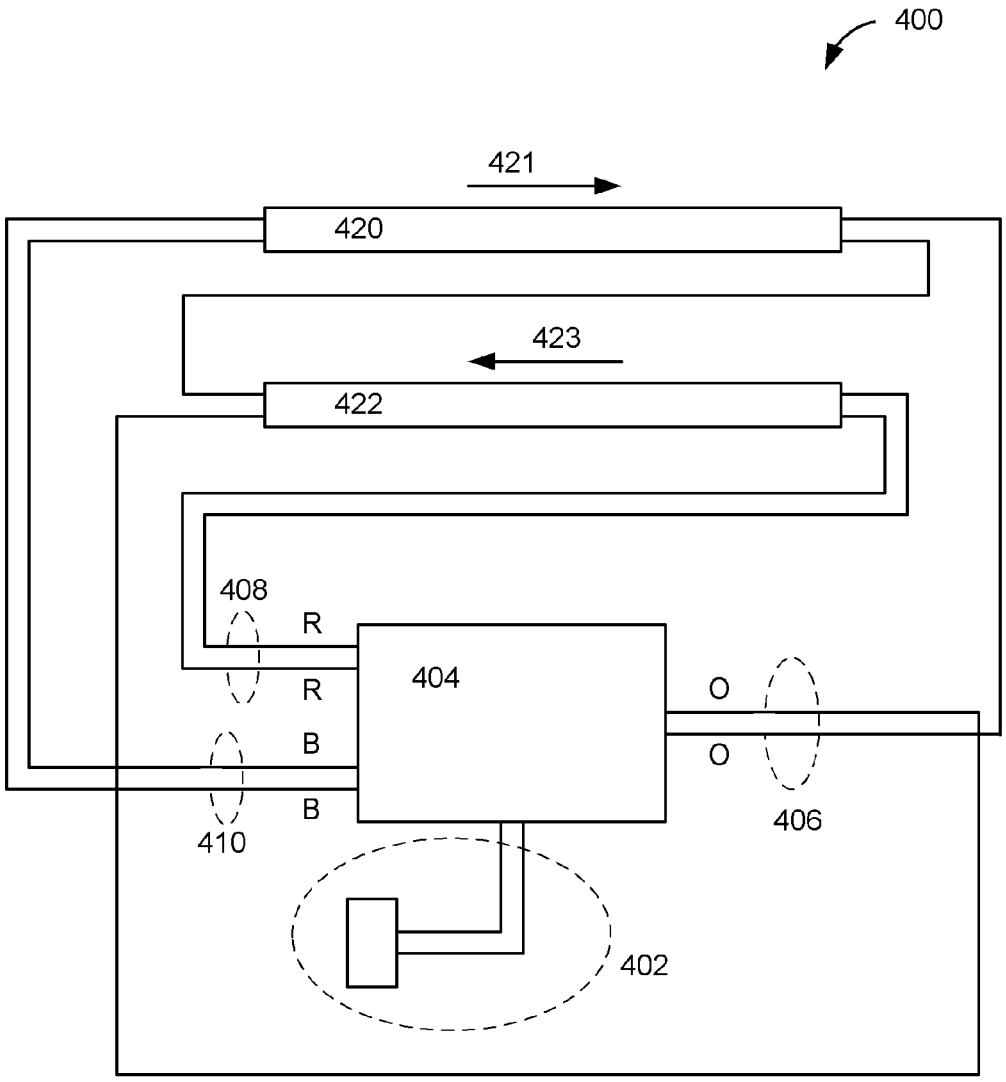
FIG. 4 illustrates one embodiment of the invention showing an approach to minimize radiation where filaments are in series.

FIG. 4, generally at 400, shows one embodiment of the invention showing how dual fluorescent tubes are connected to a ballast to have opposing current flows in the tubes to help cancel radiation where filaments are connected in series. At 402 is a power source (e.g. an alternating current (AC)) connected to a ballast 404 having common outputs 406 (denoted O and O) where one of the O 406 outputs is connected to fluorescent tube 420 at one end (in FIG. 4 on the right) and the other O 406 output is connected to tube 422 at an end which is physically opposite to tube 420's other end (in FIG. 4 on the left) and where there is another connection from the tube 420 end where 406 O output connects to another other connection on tube 422 where the other 406 O output connects. This results in the filaments at the ends where outputs O 406 enter tubes 420 and 422 being in series.

Fluorescent tube 420's other end is connected to ballast 404 outputs 410 (denoted B and B), and the fluorescent tube 422's other end is connected to ballast 404 outputs 408 (denoted R and R). At 421 and 423 are representative current flows in fluorescent tubes 420 and 422 indicating they are in opposite directions. This opposite direction helps cancel radiation emanating from fluorescent tubes 420 and 422.

One of skill in the art will appreciate that the connection scheme, such as disclosed above and illustrated in FIG. 4, can be extended to any even number of tubes where it is possible to make connections such that the currents in pairs of tubes are out of phase.

Figure 5:
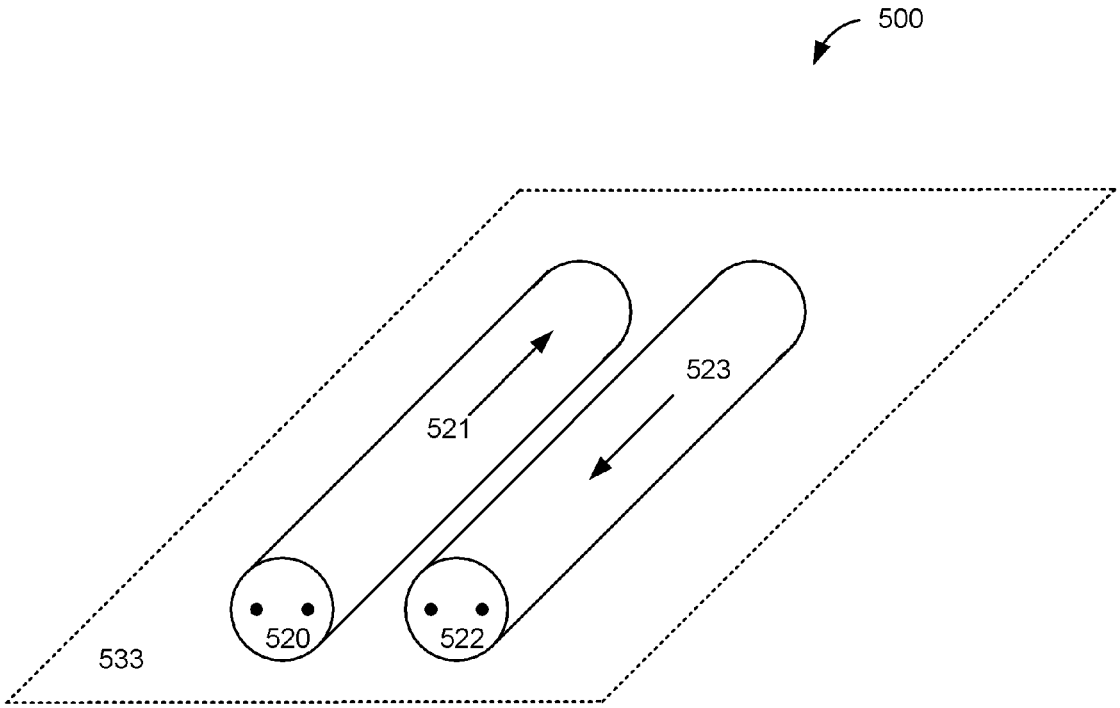
FIG. 5 illustrates one embodiment of the invention showing a common plane.

FIG. 5, generally at 500, illustrates one embodiment of the invention where fluorescent lamps 520 and 522 are located in a common plane 533. Fluorescent lamps 520 and 522 are physically proximate to each other and are electrically wired so that current flows 521 and 523 in respective fluorescent lamps 520 and 522 are out of phase with each other.

While the invention has been illustrated with straight fluorescent tubes above, the invention is not so limited.

Figure 6:
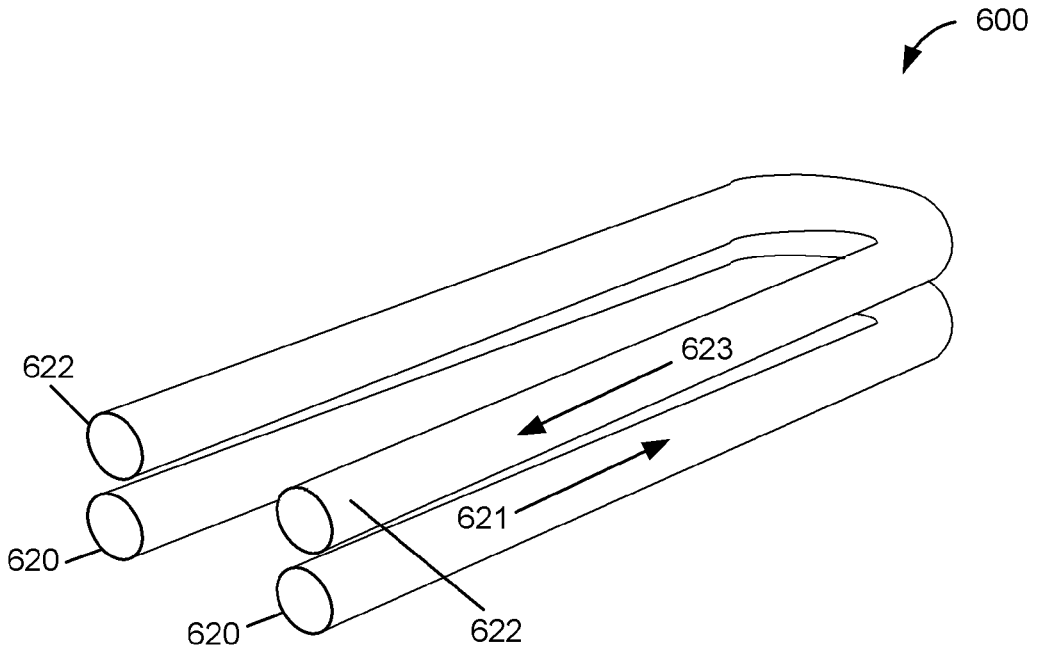
FIG. 6 illustrates one embodiment of the invention showing a U-shaped tube.

FIG. 6, generally at 600, illustrates one embodiment of the invention where Fluorescent U-Tubes 620 and 622 are in close physical proximity. Representative current flows in one leg of 620 and 622 are shown out of phase at respectively 621 and 623.

One of skill in the art will appreciate that a similar approach may be used for a variety of tube shapes such as, but not limited to, circular, spiral, etc.

Figure 7:
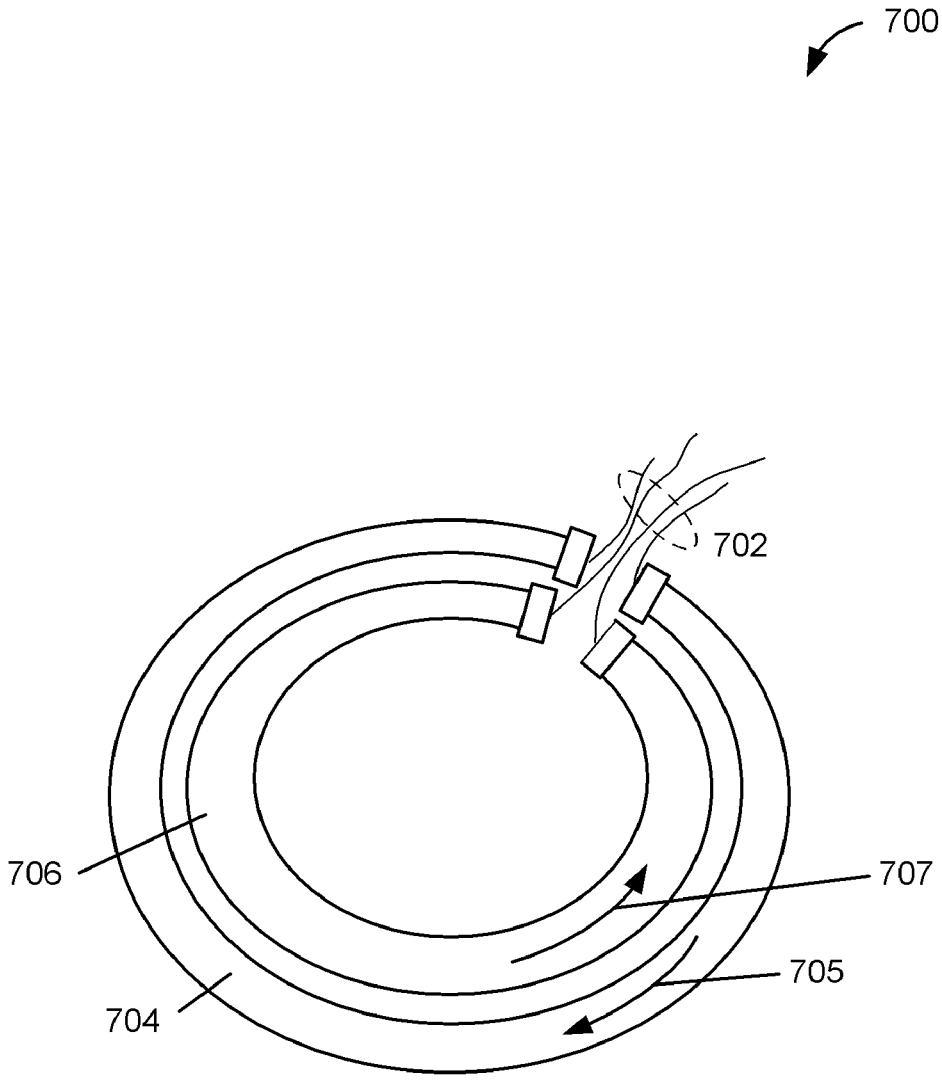
FIG. 7 illustrates one embodiment of the invention showing concentric fluorescent circular.

For example, FIG. 7, generally at 700, illustrates one embodiment of the invention where concentric fluorescent circular tubes 704 and 706 are in close physical proximity. Wire bundles 702 are for electrical connection. Current flows 705 and 707 are in tubes 704 and 706 respectively and are shown opposing each other.

One of skill in the art will appreciate that the inner tube 706 as shown in FIG. 7 is of shorter length than outer tube 704. Accordingly, the current to the tubes 704 and 706 may need to be adjusted to provide optimum cancellation of unwanted radiation. Alternatively, if the tubes, such as 704 and 706 in FIG. 7 were to be of different diameters, the currents in 704 and 706 may need to be adjusted to provide optimum cancellation of unwanted radiation. Alternatively, the tubes, such as 704 and 706 in FIG. 7 may be manufactured to have a same length by adding a sinuous path or other geometrical adjustment to the tube (e.g. an S curve introduced onto the tube).

Additionally, a combination of these techniques may be used to make radiation from the tubes equal and opposite each other, for example, but not limited to, the diameter of tubes can be adjusted, tube length can be made equal by sinuous path or other geometrical adjustment, a ballast can make currents equal and opposite by adjusting drive, etc.

Figure 8:
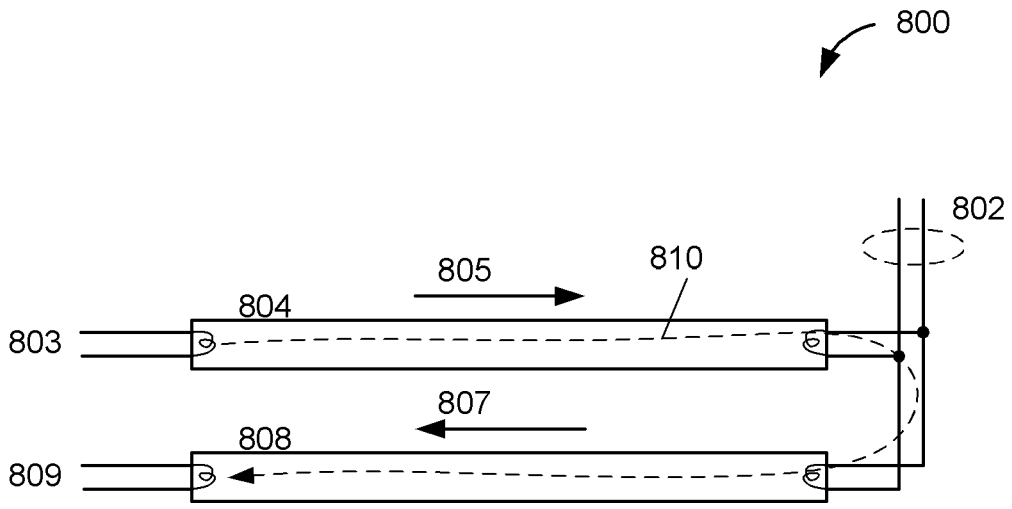
FIG. 8 illustrates one embodiment of the invention showing fluorescent tubes connected in series.

FIG. 8, generally at 800, illustrates one embodiment of the invention where fluorescent tubes are connected in series to achieve reduced radiation. Here at 802 is wiring that would go to a startup circuit, however when not connected to (or sufficiently disconnected from) the startup circuit, tubes 804 and 808 as shown are serially connected and current flowing from 803 into tube 804 takes the path indicated by the dashed line 810 through tube 804 to the wiring at 802 which connects it in series with tube 808 and the current flows through tube 808 to 809. As noted at 805 and 807 the currents in tubes 804 and 808 respectively are in opposite directions and help cancel any radiation. Note that tubes in series may need special startup procedures (e.g. after starting, disconnecting startup circuit connections (e.g. at 802)).

Figure 9:
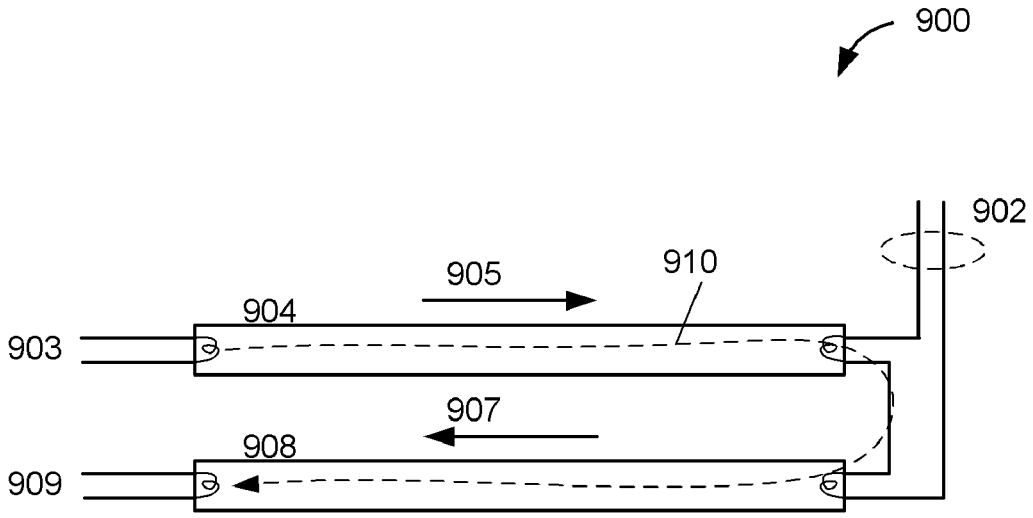
FIG. 9 illustrates one embodiment of the invention showing fluorescent tubes connected in series and where filaments are in series.

FIG. 9, generally at 900, illustrates one embodiment of the invention where fluorescent tubes are connected in series to achieve reduced radiation and where filaments are in series. Here at 902 is wiring that would go to a startup circuit, however when not connected to (or sufficiently disconnected from) the startup circuit, tubes 904 and 908 as shown are serially connected and current flowing from 903 into tube 904 takes the path indicated by the dashed line 910 through tube 904 to the wiring at 902 which connects it in series with tube 908 and the current flows through tube 908 to 909. As noted at 905 and 907 the currents in tubes 904 and 908 respectively are in opposite directions and help cancel any radiation. Note that tubes in series may need special startup procedures (e.g. after starting, disconnecting startup circuit connections (e.g. at 902)).

Figure 10:
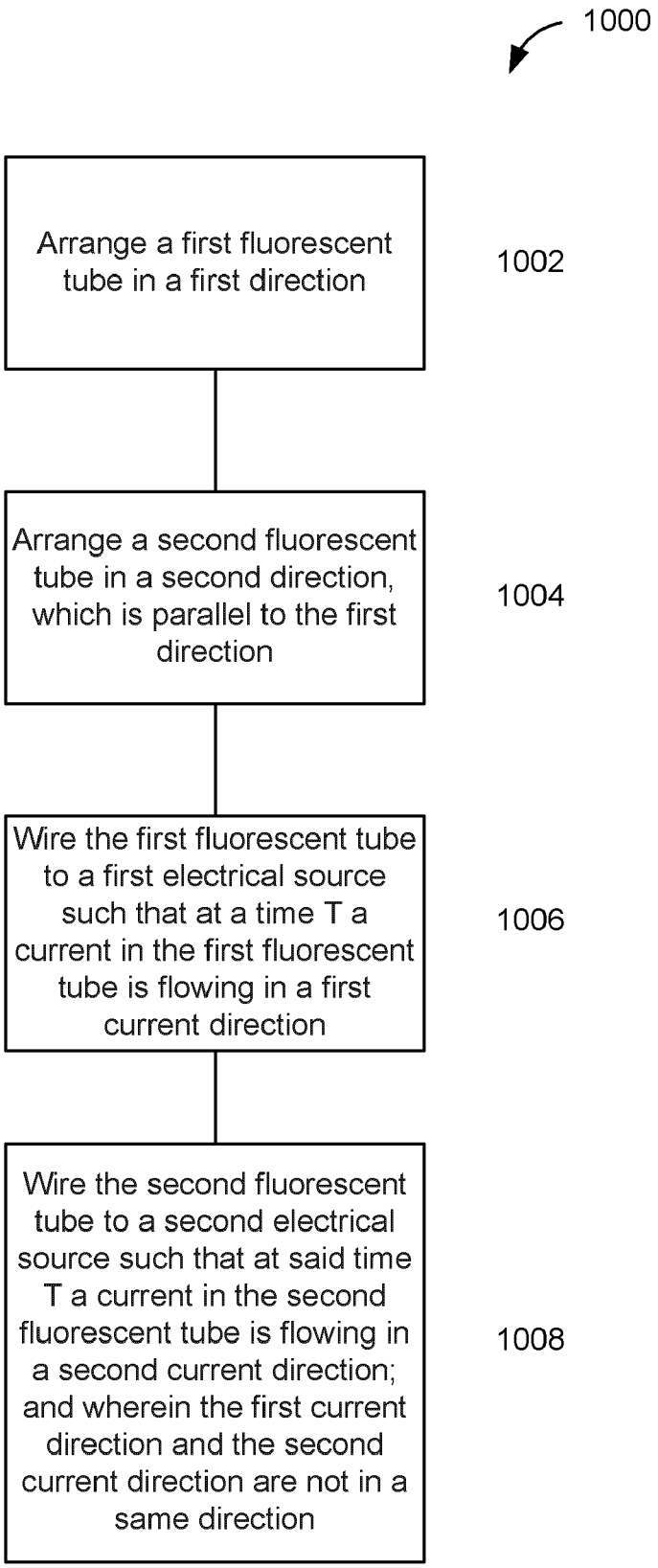
FIG. 10 illustrates one embodiment of the invention in flow chart form.

FIG. 10, generally at 1000, illustrates one embodiment of the invention in flow chart form. At 1002 Arrange a first fluorescent tube in a first direction. At 1004 Arrange a second fluorescent tube in a second direction, which is parallel to the first direction. At 1006 Wire the first fluorescent tube to a first electrical source such that at a time T a current in the first fluorescent tube is flowing in a first current direction. At 1008 Wire the second fluorescent tube to a second electrical source such that at said time T a current in the second fluorescent tube is flowing in a second current direction; and wherein the first current direction the said second current direction are not in a same direction.

Figure 11:
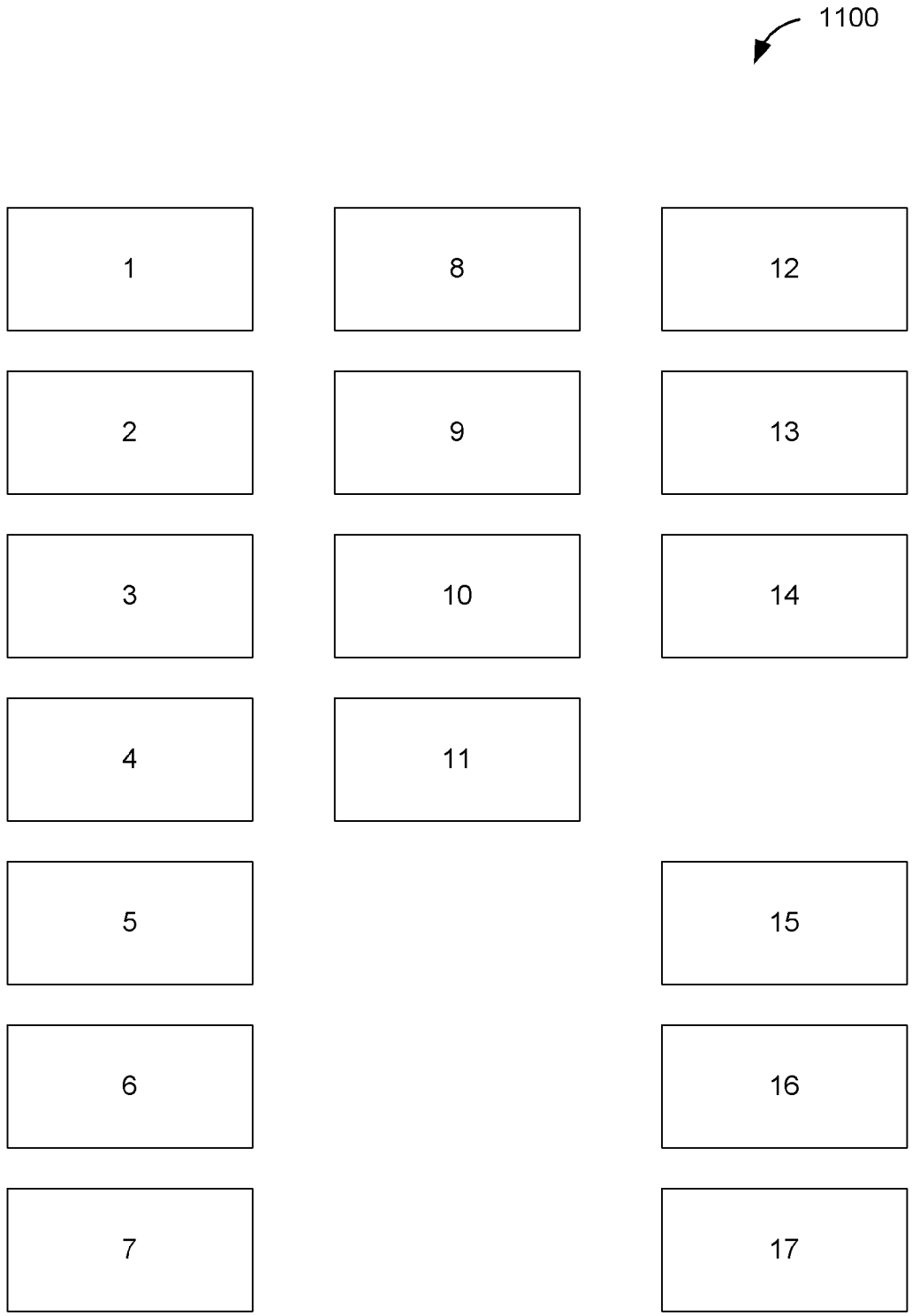
FIG. 11 illustrates various embodiments of the invention.

FIG. 11 illustrates various embodiments of the invention.

At 1. An apparatus comprising an electrically powered lighting fixture, said electrically powered lighting fixture having an even number of lighting elements wherein one-half of said even number of lighting elements have a current flowing in a first direction and wherein a remaining one-half of said even number of lighting elements have a current flowing in a second direction.

At 2. The apparatus of claim 1 wherein said first direction and said second direction are substantially opposite directions.

At 3. The apparatus of claim 2 wherein said electrically powered lighting fixture is an alternating current electrically powered lighting fixture.

At 4. The apparatus of claim 3 wherein said alternating current electrically powered lighting fixture is an alternating current electrically powered fluorescent lighting fixture.

At 5. The apparatus of claim 4 further comprising a ballast, said ballast in operative communication with said even number of lighting elements.

At 6. The apparatus of claim 5 wherein said even number of lighting elements are physically proximate to each other.

At 7. The apparatus of claim 2 further comprising an additional lighting element wherein said additional lighting element has a current flowing in a direction selected from the group consisting of said first direction and said second direction.

At 8. A method comprising:

arranging a first fluorescent tube in a first direction;

arranging a second fluorescent tube in a second direction, said second direction parallel to said first direction;

wiring said first fluorescent tube to a first electrical source such that at a time T a current in said first fluorescent tube is flowing in a first current direction; and wiring said second fluorescent tube to a second electrical source such that at said time T a current in said second fluorescent tube is flowing in a second current direction; and wherein said first current direction and said second current direction are not in a same direction.

At 9. The method of claim 8 wherein said first fluorescent tube is proximate to said second fluorescent tube.

At 10. The method of claim 8 further comprising wiring said first fluorescent tube and said second fluorescent tube in series.

At 11. The method of claim 9 wherein said first electrical source and said second electrical source are supplied from a ballast.

At 12. An apparatus comprising:

a first fluorescent lamp, said first fluorescent lamp having a first end and a second end, said first end having one or more electrical contacts, said second end having one or more electrical contacts;

a second fluorescent lamp, said second fluorescent lamp having a first end and a second end, said first end having one or more electrical contacts, said second end having one or more electrical contacts, wherein said second fluorescent lamp said first end is proximate to said first fluorescent lamp said second end, and wherein said second fluorescent lamp said second end is proximate to said first fluorescent lamp said first end;

a ballast, said ballast having a common output denoted Y, said ballast having a first output denoted R, said ballast having a second output denoted B, wherein said ballast said common output denoted Y is in operative communication with said first fluorescent lamp said second end said one or more electrical contacts, wherein said ballast said common output denoted Y is in operative communication with said second fluorescent lamp said second end said one or more electrical contacts, wherein said ballast said first output denoted R is in operative communication with said second fluorescent lamp said first end said one or more electrical contacts, and wherein said ballast said second output denoted B is in operative communication with said first fluorescent lamp said first end said one or more electrical contacts.

At 13 The apparatus of claim 12 wherein said ballast is a rapid start ballast.

At 14. The apparatus of claim 12 wherein said ballast is an electronic ballast.

At 15. A method comprising arranging an even number of lighting elements proximate to one another so that current in adjacent said lighting elements is flowing in opposite directions.

At 16. The method of claim 15 wherein said lighting elements are fluorescent tubes.

At 17. The method of claim 16 wherein said fluorescent tubes are arranged proximate to a common plane.

Reference is made to a time T and alternating current. Time T as understood by one of skill in the art is an arbitrary time when current is flowing. For example, as an AC signal reverses direction there may be a time period when current does not flow. Time T is simply meant as a time when current is flowing and the direction of that current can be determined.

Thus a method and apparatus for reducing radiation from a light fixture have been described.

For purposes of discussing and understanding the invention, it is to be understood that various terms are used by those knowledgeable in the art to describe techniques and approaches. Furthermore, in the description, for purposes of explanation, numerous specific details are set forth in order to provide a thorough understanding of the present invention. It will be evident, however, to one of ordinary skill in the art that the present invention may be practiced without these specific details. In some instances, well-known structures and devices are shown in block diagram form, rather than in detail, in order to avoid obscuring the present invention. These embodiments are described in sufficient detail to enable those of ordinary skill in the art to practice the invention, and it is to be understood that other embodiments may be utilized and that logical, mechanical, electrical, and other changes may be made without departing from the scope of the present invention.

As used in this description, "lamp" or "light" or "fixture" or "lamp fixture" or "light fixture" or "lighting elements" or "bulb" or "tube" or similar phrases refer to similar entities unless denoted otherwise by the language context.

As used in this description a ballast is understood to be a device for controlling power to a tube or lamp. A ballast may be passive or active in nature (e.g. magnetic, electronic control, etc.).

As used in this description, "one embodiment" or "an embodiment" or similar phrases means that the feature(s) being described are included in at least one embodiment of the invention. References to "one embodiment" in this description do not necessarily refer to the same embodiment; however, neither are such embodiments mutually exclusive. Nor does "one embodiment" imply that there is but a single embodiment of the invention. For example, a feature, structure, act, etc. described in "one embodiment" may also be included in other embodiments. Thus, the invention may include a variety of combinations and/or integrations of the embodiments described herein.

It is to be understood that in any one or more embodiments of the invention where alternative approaches or techniques are discussed that any and all such combinations as may be possible are hereby disclosed. For example, if there are five techniques discussed that are all possible, then denoting each technique as follows: A, B, C, D, E, each technique may be either present or not present with every other technique, thus yielding 2^5 or 32 combinations, in binary order ranging from not A and not B and not C and not D and not E to A and B and C and D and E. Applicant(s) hereby claims all such possible combinations. Applicant(s) hereby submit that the foregoing combinations comply with applicable EP (European Patent) standards. No preference is given any combination.

Thus a method and apparatus for reducing radiation from a light fixture have been described.

What is claimed is:

1. An apparatus comprising an electrically powered lighting fixture, said electrically powered lighting fixture having an even number of lighting elements; wherein each of said even number of lighting elements is independently driven in said electrically powered lighting fixture, wherein one-half of said even number of lighting elements have a current flowing in a first direction, and wherein a remaining one-half of said even number of lighting elements have a current flowing in a second direction to reduce radiated fields.

2. The apparatus of claim 1 wherein said first direction and said second direction are substantially opposite directions.

3. The apparatus of claim 2 wherein said electrically powered lighting fixture is an alternating current electrically powered lighting fixture.

4. The apparatus of claim 3 wherein said alternating current electrically powered lighting fixture is an alternating current electrically powered fluorescent lighting fixture.

5. The apparatus of claim 4 further comprising a ballast, said ballast in operative communication with said even number of lighting elements.

6. The apparatus of claim 5 wherein said even number of lighting elements are physically proximate to each other.

7. The apparatus of claim 2 further comprising an additional lighting element wherein said additional lighting element has a current flowing in a direction selected from the group consisting of said first direction and said second direction.

8. A method comprising:

arranging a first fluorescent tube in a first direction;

arranging a second fluorescent tube in a second direction, said second direction parallel to said first direction;

wiring said first fluorescent tube to a first electrical source such that at a time (T) a current in said first fluorescent tube is flowing in a first current direction; and wiring said second fluorescent tube to a second electrical source such that at said time (T) a current in said second fluorescent tube is flowing in a second current direction to reduce radiated fields; wherein said first fluorescent tube and said second fluorescent tube are independently driven by said first electrical source and said second electrical source respectively, and wherein said first current direction and said second current direction are not in a same direction.

9. The method of claim 8 wherein said first fluorescent tube is proximate to said second fluorescent tube.

10. The method of claim 8 further comprising wiring said first fluorescent tube and said second fluorescent tube in series.

11. The method of claim 9 wherein said first electrical source and said second electrical source are supplied from a ballast.

12. An apparatus comprising:

a first fluorescent lamp, said first fluorescent lamp having a first end and a second end, said first end having one or more electrical contacts, said second end having one or more electrical contacts;

a second fluorescent lamp, said second fluorescent lamp having a first end and a second end, said first end having one or more electrical contacts, said second end having one or more electrical contacts, wherein said first end of said second fluorescent lamp is proximate to said second end of said first fluorescent lamp, and wherein said second end of said second fluorescent lamp is proximate to said first end of said first fluorescent lamp;

a ballast, said ballast having a common output denoted (Y), said ballast having a first output denoted (R), said ballast having a second output denoted (B), wherein said common output of said ballast denoted (Y) is in operative communication with said one or more electrical contacts of said second end of said first fluorescent lamp, wherein said common output of said ballast denoted (Y) is in operative communication with said one or more electrical contacts of said of said second end of said second fluorescent lamp, wherein said first output of said ballast denoted (R) is in operative communication with said one or more electrical contacts of said first end of said second fluorescent lamp, and wherein said second output of said ballast denoted (B) is in operative communication with said one or more electrical contacts of said first end of said first fluorescent lamp to reduce radiated fields.

13. The apparatus of claim 12 wherein said ballast is a rapid start ballast.

14. The apparatus of claim 12 wherein said ballast is an electronic ballast.

15. A method comprising arranging an even number of lighting elements proximate to one another so that current in adjacent said lighting elements is flowing in opposite directions to reduce radiated fields; and wherein each of said even number of lighting elements is independently driven by a separate current source.

16. The method of claim 15 wherein said lighting elements are fluorescent tubes.

17. The method of claim 16 wherein said fluorescent tubes are arranged proximate to a common plane.

* * * * *